United States Patent [19]

Sabreen et al.

[11] 4,169,537

[45] Oct. 2, 1979

[54] STORAGE DRUM

[75] Inventors: Bernard S. Sabreen; Martin Aaron, both of Philadelphia, Pa.

[73] Assignee: Centennial Plastics Co., Inc., Camden, N.J.

[21] Appl. No.: 889,154

[22] Filed: Mar. 22, 1978

[51] Int. Cl.[2] ..... B65D 7/44

[52] U.S. Cl. ..... 220/70; 220/72

[58] Field of Search ..... 220/70, 72, DIG. 1, 220/5 R, 66; 206/509

[56] References Cited

U.S. PATENT DOCUMENTS

| | | | |
|---|---|---|---|
| 2,063,013 | 12/1936 | Cooper | 220/72 |
| 2,758,742 | 8/1956 | Farrell | 206/509 X |
| 3,194,468 | 7/1965 | Baron | 220/72 X |
| 3,195,760 | 7/1965 | Bulgrin | 220/5 R |
| 3,279,640 | 10/1966 | Dodson | 220/5 R |
| 3,598,270 | 8/1971 | Adomaitis | 220/70 X |
| 3,659,741 | 5/1972 | Corelli | 220/72 X |
| 3,927,790 | 12/1975 | Chase et al. | 220/72 |
| 3,955,705 | 5/1976 | Dubois et al. | 206/509 X |
| 3,985,257 | 10/1976 | Shaffer et al. | 220/DIG. 1 |
| 3,998,174 | 12/1976 | Saunders | 220/70 X |
| 4,023,679 | 5/1977 | Himmes | 220/66 X |
| 4,048,934 | 9/1977 | Wallace | 220/70 X |
| 4,094,432 | 6/1978 | Zilbert | 220/70 X |

FOREIGN PATENT DOCUMENTS

| | | | |
|---|---|---|---|
| 58857 | 4/1954 | France | 220/72 |
| 1297050 | 11/1972 | United Kingdom | 206/509 |

*Primary Examiner*—Allan N. Shoop

*Attorney, Agent, or Firm*—Caesar, Rivise, Bernstein & Cohen, Ltd.

[57] ABSTRACT

A plastic drum for the storage of liquid or other flowable materials and suitable for industrial applications. The drum consists of a circular side wall, a flat top wall and a bulged bottom wall. The top wall includes a threaded fill hole and a threaded vent. Each hole is surrounded by an upstanding undercut lip. A circular flange is located at the juncture of the top wall and the side wall. The flange extends above the plane of the top wall and beyond the outer periphery of the side wall. The walls of the drum are each of the same thickness. The circular side wall includes a plurality of elongated arcuate depressions equidistantly spaced about the periphery thereof to form strengthening ribs. The bottom wall includes a peripheral ledge projecting downward to form a planar base for the drum. The center of the bulged portion of the bottom wall is coplanar with the base. A slot is provided in the flange about the top wall.

9 Claims, 4 Drawing Figures

STORAGE DRUM

This invention relates generally to storage containers, and more particularly to drums for storing flowable materials.

As is known, the storage of liquids or other flowable materials in industrial applications has historically been accomplished by the use of 55 gallon steel drums. Such drums are of circular cylindrical shaped having a flat top wall, a flat bottom wall and a circular side wall extending therebetween. Plural lifting ribs extend around the midportion or girth of the side wall and one lifting rib extends around the juncture of the top wall and the side wall. The lifting ribs are arranged to receive the tines of forklift apparatus for effectuating the handling and transportation of the drums.

In the U.S. Pat. No. 2,997,197 (Ficker et al) and U.S. Pat. No. 3,922,984 (Zuideveld et al) there are shown conventional type 55 gallon steel storage drums.

While conventional 55 gallon steel storage drums have proved suitable for storage and handling of liquids and other flowable materials, such drums nevertheless exhibit several drawbacks. Among the most severe drawbacks are the fact that such drums are heavy, and are susceptible to corrosion or other mechanical injury.

While the desirability of constructing large storage drums of plastic has been recognized, the inherent flexibility or pliability of plastics would render any drum formed thereof in the shape of conventional steel drums less rigid and stable than comparably dimensioned steel drums. These limitations outweigh the lightweight and corrosion resistance of plastics, to prevent the use of plastics as a material for forming storage drums suitable for industry.

In U.S. Pat. No. 3,940,011 (Dubois et al) and U.S. Pat. No. 3,987,926 (Yavorsky) there are disclosed plastic drums ostensibly suitable for industrial storage applications. While such drums may be sufficiently strong to store commercial quantities of material, e.g., 55 gallons, therein without deformation, it appears the construction of such drums renders them incompatible with the handling techniques utilized for conventional steel drums.

Accordingly it is the general object of the instant invention to overcome the disadvantages of the prior art.

It is further the object of the instant invention to provide a plastic drum which is simple in construction, light in weight and compatible with conventional drum-handling techniques.

This further object of the instant invention is to provide a plastic storage drum having a stable base support and a strengthened side wall.

These and other objects of the instant invention are achieved by providing a drum for storing flowable materials. The drum is formed of plastic and has a cylindrical side wall, a bottom wall, a top wall and a flange at the juncture of the top wall and side wall. Each of the walls is of the same thickness. The bottom wall includes a peripheral ledge projecting downward to form a planar base for the drum and a domed portion extending downward. The center of the domed portion is coplanar with the base. The side wall includes plural longitudinally extending reinforcing ribs equidistantly spaced about the periphery of the side wall. Each of the ribs is in the form of an elongated arcuate depression in the side wall.

Other objects and many of the attendant advantages of the instant invention will become readily apparent by reference to the accompanying drawing wherein.

Referring now in greater detail to the various figures of the drawing wherein like reference characters refer to like parts, there is shown generally at 20 in FIG. 1 a drum for storage of liquids or other flowable materials constructed in accordance with the instant invention.

Figure 1:
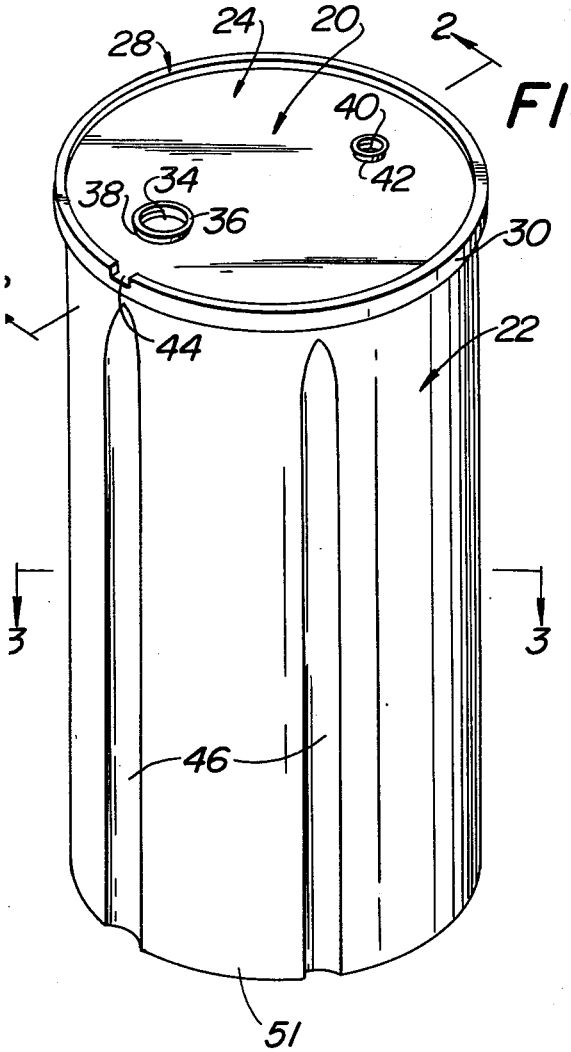
FIG. 1 is a perspective view of a drum in accordance with the instant invention.
Figure 2:
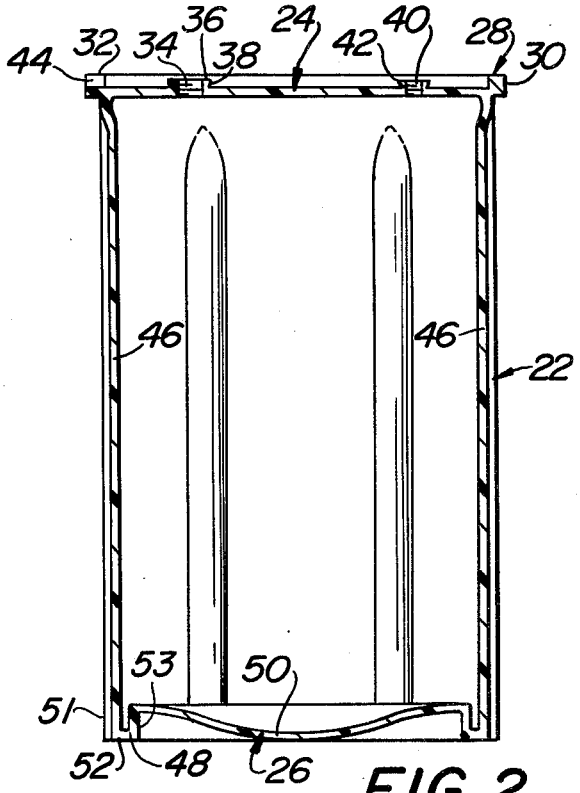
FIG. 2 is a sectional view taken along line 2—2 of FIG. 1.
Figure 3:
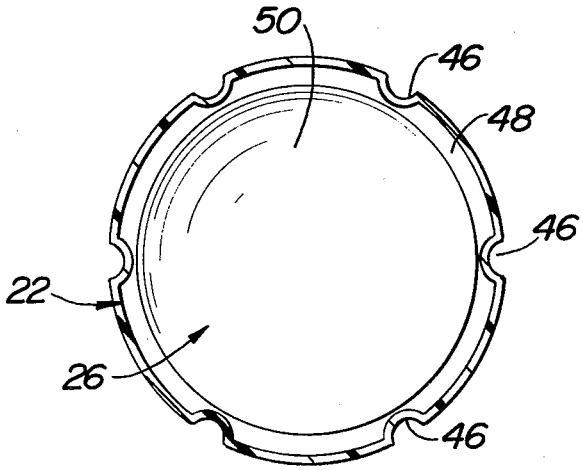
FIG. 3 is a sectional view taken along line 3—3 of FIG. 1.

As can be seen in FIG. 1, the drum 20 is formed as a shell and basically comprises a circular side wall 22, a top wall 24 and a bottom wall 26 (FIG. 2). The thickness of the shell, that is, the side wall 22, top wall 24, and bottom wall 26, is constant throughout the structure.

A circular flange 28 is located at the juncture of the top of the side wall 22 and the edge of the top wall 24. The flange 28 is wider than the thickness of the side wall 22 such that its outside surface 30 extends beyond the peripheral surface of the side wall 22. The flange 28 also extends upward beyond the top surface of the top wall 24 and terminates in a flat surface 32 at its upper edge.

Figure 4:
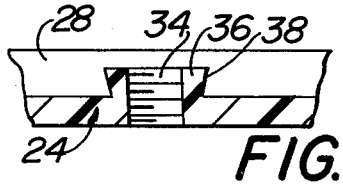
FIG. 4 is an enlarged view of a portion of the sectional view of FIG. 2.

Referring to FIGS. 1 and 2 it can be seen that the top wall 24 includes a threaded opening 34. The opening 34 serves as the fill hole for the drum. The internal threads of the hole serve to accommodate a bung (not shown). An upstanding lip 36 extends about fill hole 34. The lip 36, as can be seen clearly in FIG. 4, includes a downwardly tapered, undercut outside surface 38. The lip 38 is arranged to receive a overcap seal (not shown) to preclude tampering with the contents of the drum. A smaller threaded opening 40 is also provided in the top wall 24. The threaded opening 40 serves as a vent for the drum. Like fill hole 34 vent 40 includes an upstanding lip 42 extending about its periphery and which lip is downwardly tapered and undercut to accommodate a overcap seal.

In order to preclude the collection of rain or other liquids on the top of the drum a drain slot 44 is cut in the flange 28. The bottom of the drain slot is coplanar with the top surface of the top wall 24.

In order to reinforce the drum to prevent it from bowing out or distorting when filled, a plurality of longitudinally extending reinforcing ribs are provided at equidistatnly spaced locations about the periphery of the circular side wall 22. Each of the ribs is in the form of an elongated arcuate depression in the side wall 22. Each rib extends for virtually the entire height of the side wall. The upper end of each reinforcing rib merges into the plane of the side wall immediately below the flange 28.

The bottom wall 26 of the drum 20 is in the form of a circular ledge 48 and a domed or bulged central portion 50. The ledge extends about the entire periphery of the side wall 22, with its outer surface 51 flush with the outer surface of the sidewall. The ledge includes a flat bottom surface 52 which extends radially inward and forms the base for the drum and an inner cylindrical surface 53 extending upward from the bottom surface 52. The top of the inner cylindrical surface 53 merges into the periphery of the domed portion 50. The flat bottom surface 52 is adapted to be disposed upon any supporting surface. The central portion 50 of the bottom wall 26 bulges downwardly with the outside surface of the center of portion 50 being coplanar with the bottom surface 52 of the base. Accordingly, when drum 20 is filled a stable base results.

While various plastics may be utilized to form the drum of the instant invention one particularly effective plastic is the thermoplastic cross-linked polyethylene. When constructing a drum of such a material sufficient strength can be achieved with wall thicknesses as thin as one quarter of an inch (6.35 mm).

In view of the foregoing it should be appreciated that the drum 20 of the instant invention is light in weight, strong, rigid and corrosion-resistant, yet is as amenable to conventional handling techniques as conventional steel storage drums.

Without further elaboration, the foregoing will so fully illustrate my invention that others may, by applying current or future knowledge, readily adapt the same for use under various conditions of service.

What is claimed as the invention is:

1. A drum for storing flowable materials, said drum being formed as an integral unit of thermoplastic and having a cylindrical sidewall, a bottom wall, a top wall and a radially outwardly projecting flange at the juncture of the top wall and sidewall, each of said walls being of the same thickness throughout, said bottom wall including a peripheral ledge and a domed portion, said ledge having an outer cylindrical surface which is flush with said cylindrical sidewall and in the same plane therewith, a flat bottom surface extending radially inward from said outer cylindrical surface and an inner cylindrical surface extending upwardly from said bottom surface and merging with said domed portion, said bottom surface forming a planar base for the drum and said domed portion curving downward from the point immediately adjacent said ledge to the center of said bottom wall, the center of the domed portion being coplanar with the bottom surface, said side wall including plural parallel longitudinally extending reinforcing ribs equidistantly spaced about the periphery of the sidewall, each of said ribs being in the form of an elongated arcuate depression in the sidewall exterior and extending continuously the full height of the drum from the bottom surface of said ledge to immediately below the flange of said top wall.

2. The drum of claim 1, wherein said flange extends upward above the top wall.

3. The drum of claim 2 wherein said flange includes a slot in the edge thereof.

4. The drum of claim 3 wherein said top wall includes an opening for said material and a vent aperture.

5. The drum of claim 4 wherein an upstanding, undercut lip extends about said opening and wherein an upstanding undercut lip extends about said vent aperture.

6. The drum of claim 5 wherein said opening is threaded and wherein said vent aperture is threaded.

7. The drum of claim 6 wherein said thermoplastic is cross-linked polyethylene.

8. The drum of claim 7 wherein said wall thickness is one quarter inch (6.35 mm).

9. The drum of claim 2, wherein the inner cylindrical surface of the ledge is disposed vertically.

* * * * *